US009371780B2

(12) United States Patent
Toth et al.

(10) Patent No.: US 9,371,780 B2
(45) Date of Patent: Jun. 21, 2016

(54) FOUR-STROKE INTERNAL COMBUSTION ENGINE COMPRISING AN ENGINE BRAKE

(75) Inventors: Gyula Toth, Budapest (HU); Michael Gröger, Proleb (AT)

(73) Assignee: AVL LIST GMBH, Graz (AT)

( * ) Notice: Subject to any disclaimer, the term of this patent is extended or adjusted under 35 U.S.C. 154(b) by 468 days.

(21) Appl. No.: 13/825,817

(22) PCT Filed: Aug. 29, 2011

(86) PCT No.: PCT/EP2011/064773

§ 371 (c)(1),
(2), (4) Date: Jun. 14, 2013

(87) PCT Pub. No.: WO2012/038195

PCT Pub. Date: Mar. 29, 2012

(65) Prior Publication Data

US 2013/0269652 A1 Oct. 17, 2013

(30) Foreign Application Priority Data

Sep. 23, 2010 (AT) ..... 1584/2010

(51) Int. Cl.

| | |
|---|---|
| ***F02D 9/06*** | (2006.01) |
| ***F01L 1/18*** | (2006.01) |
| ***F01L 13/06*** | (2006.01) |
| ***F02D 13/02*** | (2006.01) |
| ***F02D 13/04*** | (2006.01) |
| ***F01L 1/26*** | (2006.01) |

(52) U.S. Cl.

CPC ... *F02D 9/06* (2013.01); *F01L 1/18* (2013.01); *F01L 1/181* (2013.01); *F01L 1/267* (2013.01); *F01L 13/06* (2013.01); *F02D 13/0273* (2013.01); *F02D 13/04* (2013.01); *F01L 2001/186* (2013.01)

(58) Field of Classification Search

CPC ... F02D 9/06; F02D 2009/0242; F02D 13/04; F02D 13/0273; F01L 13/06; F01L 1/181; F01L 1/267; F01L 1/18

See application file for complete search history.

(56) References Cited

U.S. PATENT DOCUMENTS

| | | | | |
|---|---|---|---|---|
| 6,257,201 | B1 * | 7/2001 | Kajiura et al. | 123/321 |
| 2008/0308055 | A1 * | 12/2008 | Swanbon et al. | 123/90.46 |
| 2010/0037854 | A1 * | 2/2010 | Yang | 123/321 |

* cited by examiner

*Primary Examiner* — Lindsay Low
*Assistant Examiner* — Jacob Amick
(74) *Attorney, Agent, or Firm* — Jordan IP Law, LLC; Todd A. Vaughn

(57) ABSTRACT

A four-stroke internal combustion engine having an engine brake, at least one exhaust valve per cylinder, each valve actuated by a camshaft and at least one first valve lever arrangement, and a device which advances the exhaust control, with the valve lever arrangement having an exhaust lever actuated by an exhaust cam and a brake lever actuated by a brake cam. The brake lever has a first brake lever part on the side of the camshaft and a second brake lever part on the side of the exhaust valve, with the two brake lever parts being rotatably mounted independent of each other about a lever axis and being rotationally connectable with each other in engine braking operation by a locking element which is adjustable between two positions.

21 Claims, 4 Drawing Sheets

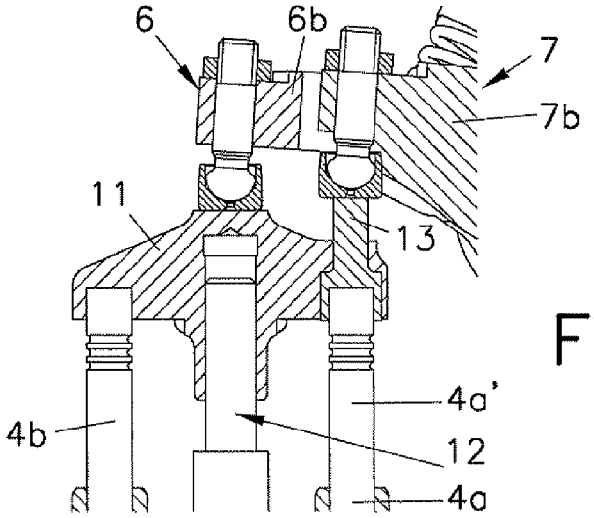
Fig.3
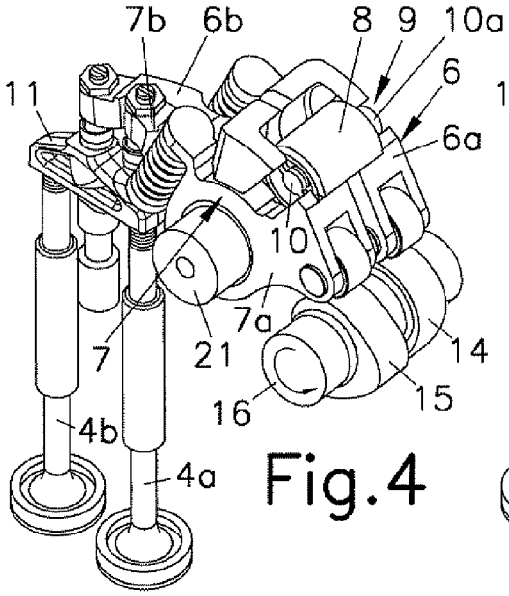
Fig.4
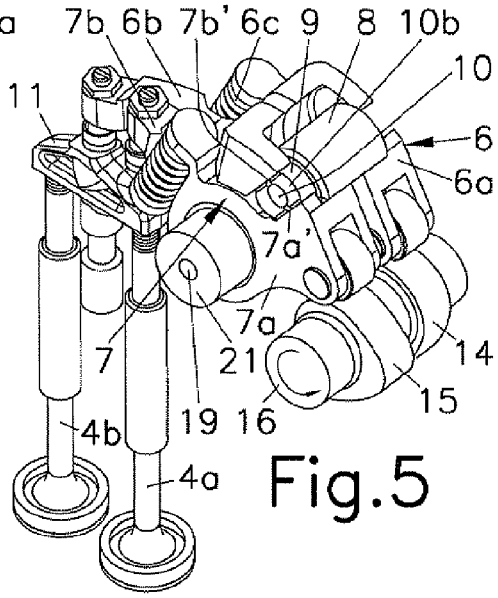
Fig.5
Fig.6
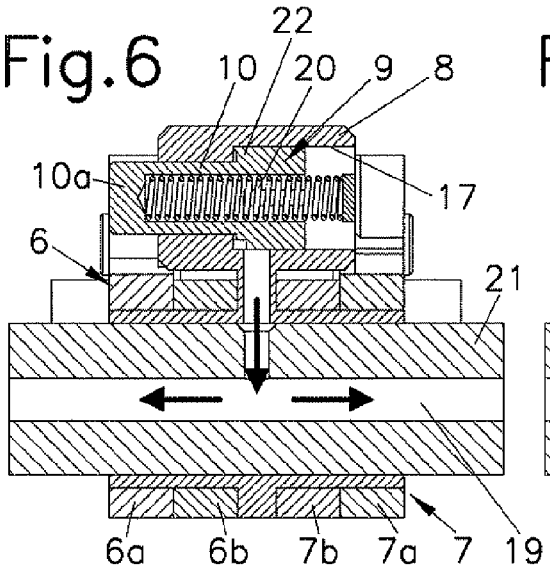
Fig.7
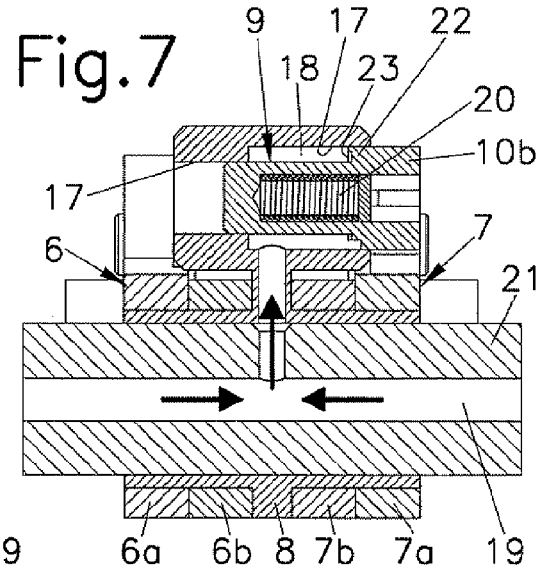

FOUR-STROKE INTERNAL COMBUSTION ENGINE COMPRISING AN ENGINE BRAKE

CROSS-REFERENCE TO RELATED APPLICATIONS

The present application is a National Stage Application of PCT International Application No. PCT/EP2011/064773 (filed on Aug. 29, 2011), under 35 U.S.C. §371, which claims priority to Austrian Patent Application No. A 1584/2010 (filed on Sep. 23, 2010), which are each hereby incorporated by reference in their respective entireties.

TECHNICAL FIELD

Embodiments of the invention relate to a four-stroke internal combustion engine, comprising an engine brake, at least one exhaust valve per cylinder, said valve being actuated by means of a camshaft and at least one first valve lever arrangement, and a device for advancing the exhaust control, with the valve lever arrangement having an exhaust lever actuated by an exhaust cam and a brake lever that can be actuated by a brake cam, with the brake lever comprising a first brake lever part on the side of the camshaft and a second brake lever part on the side of the exhaust valve, with the two brake lever parts being rotatably mounted independent of each other about a lever axis and being rotationally connectable with each other in engine braking operation by a locking element which is adjustable between two positions.

BACKGROUND

It is known to assign a separate engine-brake valve in an internal combustion engine in addition to the exhaust valves, which engine-brake valve will be actuated in a cyclic manner or will be open permanently. Such engine-brake valves are usually actuated hydraulically or pneumatically and are known for example from DE 44 23 657 C2, DE 38 39 452 C2, DE 38 39 450 C2, AT 004.387 U1 or AT 003.600 U1. An engine-brake device is further known from DE 41 25 831 A1, the engine-brake valve of which can be actuated electrically.

Known actuating devices for engine-brake valves require a relatively high constructional effort and require a comparatively large amount of space in the cylinder head, which can be provided only with difficulty in many cases. In order to depressurize the cylinder pressure, an additional container and a high-pressure oil system with a high-pressure pump and electrohydraulic valves are required for each cylinder. Furthermore, known engine-brake devices comprise a large number of individual parts which increase the susceptibility to malfunctions and have a disadvantageous effect on the production process.

DE 39 36 808 A1 describes an exhaust-cam-controlled engine brake for four-stroke internal combustion engines, in which the exhaust control is advanced by approximately one working stroke, i.e. a crank angle of approx. 180°, for the duration of the required braking effect. This leads to a doubling of the braking cycles and a decompression at the end of the compression stroke, by means of which a higher sustained-action braking effect can be achieved.

U.S. Pat. No. 6,000,374 A describes an engine brake for an internal combustion engine in which several braking phases can be realized per working cycle. An additional brake rocker arm is provided per cylinder in addition to the intake and exhaust rocker arms, said additional brake rocker arm, which is driven by a brake cam, actuating an exhaust valve. All rocker arms comprise a hydraulic element at its valve-side end. Solenoids can influence which hydraulic elements will be subjected to compressed oil and which will not. It is ensured in this manner that in normal working operation the brake rocker arm will only run empty and the exhaust valve will not be actuated by the brake rocker arm because its hydraulic element is unable to transmit the force without oil supply. The intake and exhaust rocker arms will operate in working operation as long as their hydraulic elements are filled with oil. The hydraulic elements of the exhaust rocker arms will be deactivated in braking operation and the hydraulic elements of the brake rocker arms will be activated. This also allows hydraulically manipulating the valve movements in order to ensure brake power control and adjustment to each rotational speed. It is disadvantageous that a high control input is required.

An engine braking device for an internal combustion engine is known from JP 05-33684 A, which comprises two exhaust valves per cylinder, said exhaust valves being actuated in driving operation via a valve bridge by an exhaust cam and an exhaust valve lever. A divided brake lever is arranged adjacent to the exhaust valve lever, the two parts of which are rotatably mounted about the valve lever axis independent of one another. A brake cam acts on the brake valve lever part on the camshaft side. The brake lever part on the valve side acts on the valve shaft of one of the two exhaust valves. The two brake valve lever parts are rotationally connected with each other in engine braking operation via a locking device, so that the elevation of the brake cam will be transmitted via the brake lever onto the one exhaust valve. Only simple braking phases can be realized with this mechanism.

Similar engine brake devices with levers or lever parts which can be connected with each other by a locking element are known from the publications EP 1 113 151 A2, EP 0 826 867 A1, JP 2004 084 596 A, EP 0 420 159 A1, U.S. Pat. No. 5,809,952 A, JP 01-003 210 A or EP 0 588 336 A1. It is a common aspect in all these devices that they are not suitable for a dual-phase braking effect.

SUMMARY

It is the object of the invention to avoid these disadvantages and to enable doubled braking phases in a four-stroke internal combustion engine in the simplest possible and most compact way.

This will be achieved in accordance with embodiments of the invention in such a way that the exhaust lever comprises a first exhaust lever part on the camshaft side and a second exhaust lever part on the exhaust valve side, with the two exhaust lever parts being rotatably mounted about the lever axis and being rotationally connectable by the locking element outside of the engine braking operation.

Preferably, a first position of the locking element is associated with driving operation and a second position with engine braking operation, with the exhaust lever being activated and the brake lever deactivated in the first position, and the brake lever being activated and the exhaust lever deactivated in the second position. It is thereby ensured that the exhaust lever will be deactivated during braking operation and the brake lever during normal driving operation. Dual-phase braking operation can be achieved in this manner.

The locking element can be formed by a preferably stepped piston, which is displaceably mounted in a preferably stepped guide cylinder parallel to the lever axis. It is especially advantageous when the locking element is mounted on a middle lever which is rotatably mounted about the lever axis between the exhaust lever and the brake lever, with preferably the middle lever being rotationally connectable via the locking element with the respectively activated valve lever (brake lever or exhaust lever). Since the middle lever will always be co-moved with the loaded valve lever, there will not be any relative movement between the middle lever and parts of the loaded valve lever, so that wear and tear can be kept at a low level.

In order to keep the mechanical loading of the locking elements as low as possible, the locking element can respectively be slid between the pressure areas of the two brake lever parts or exhaust lever parts. As a result, the locking element will not be loaded by shearing forces but only by pressure forces, and wear and tear will be reduced substantially.

Doubled braking phases can be enabled in such a way that the brake cam is arranged with respect to the exhaust cams in a phase-shifted manner advanced by approximately 90°.

The brake lever preferably acts directly on the valve shaft of a first exhaust valve and the exhaust lever acts indirectly via a valve bridge on at least one first and one second exhaust valve per cylinder.

It can further be provided within the scope of the invention that the locking element is hydraulically or pneumatically displaceable between the two positions, preferably against the force of a restoring spring, with preferably an annular face surface which is formed by a shoulder of the piston bordering a pressure chamber, preferably within the middle lever, with the pressure chamber being connected with a pressure line.

DRAWINGS

Embodiments of the invention will be explained below in closer detail by reference to the drawings, wherein:

FIG. 3 illustrates the engine brake in a longitudinal sectional view through the exhaust valves and the valve bridge.

FIG. 4 illustrates the engine brake in driving operation with closed exhaust valves.

FIG. 5 illustrates the engine brake in engine braking operation with closed exhaust valves.

FIG. 6 illustrates the engine brake in a longitudinal sectional view through the locking element in a first position.

FIG. 7 illustrates the engine brake in a longitudinal sectional view through the locking element in a second position.

DESCRIPTIONS

Figure 1:
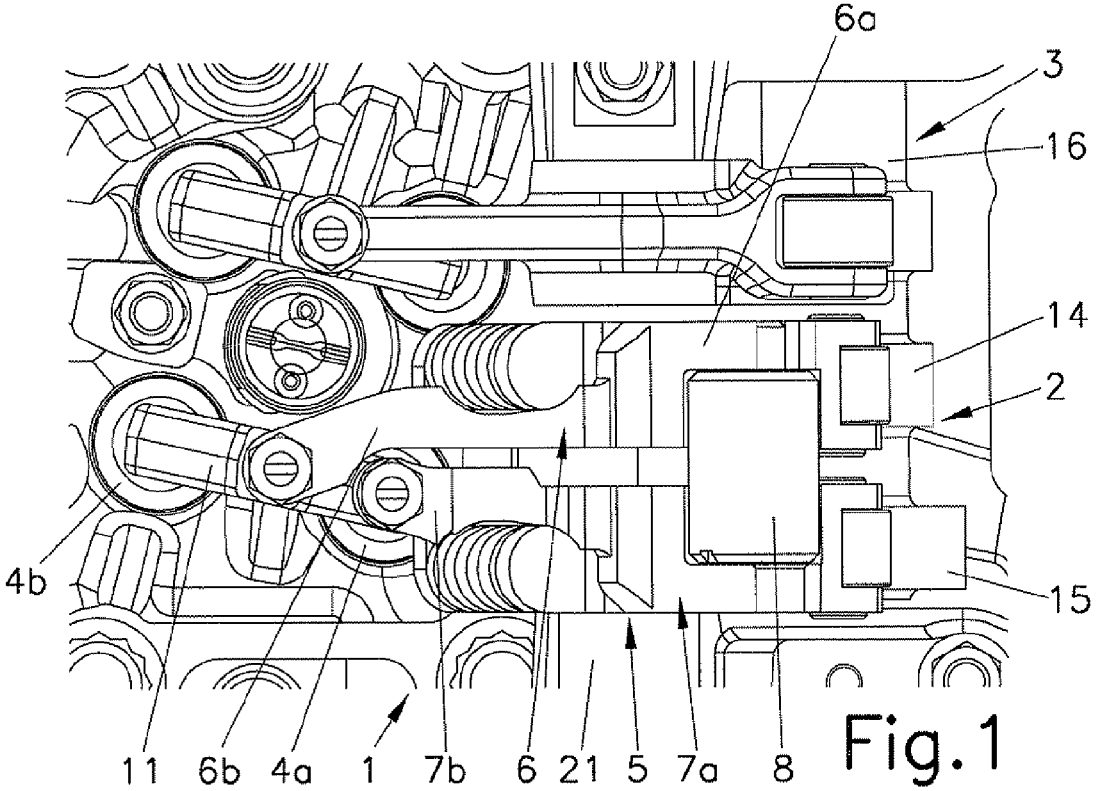
FIG. 1 illustrates a top view of a cylinder head of an internal combustion engine in accordance with embodiments of the invention.
Figure 2:
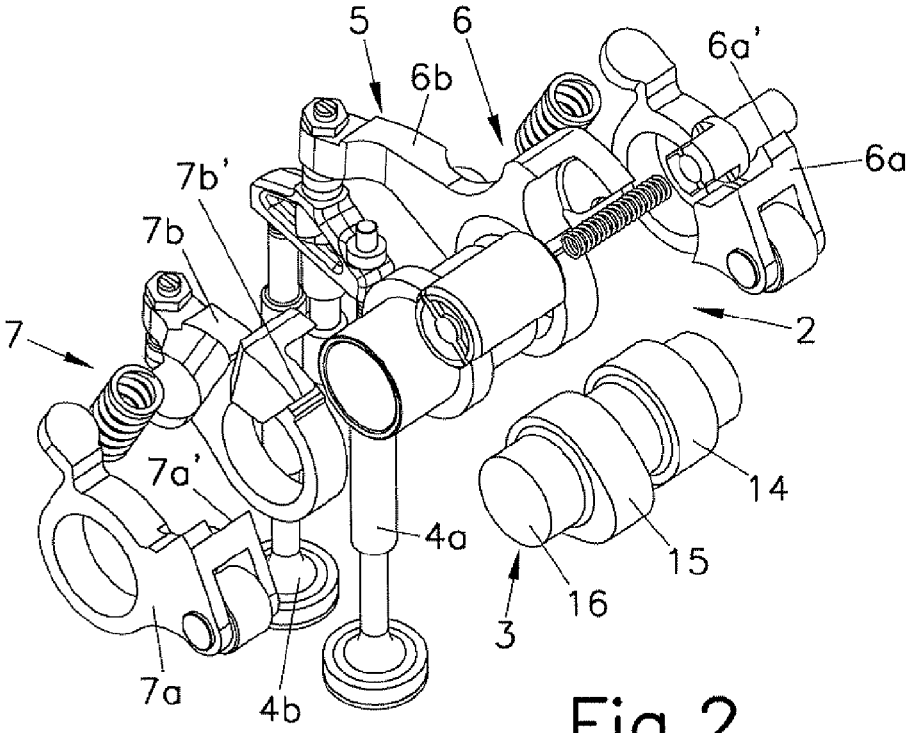
FIG. 2 illustrates an exploded view of an engine brake of the internal combustion engine in accordance with embodiments of the invention.

FIG. 1 illustrates a cylinder head 1 for the application of an engine brake 2 in accordance with embodiments of the invention. The engine brake 2 consists of a valve actuation device 3 for actuating two exhaust valves 4*a*, 4*b* per cylinder, wherein the exhaust valves 4*a*, 4*b* can be actuated by a valve lever arrangement 5 by a camshaft 16. The valve lever arrangement 5 comprises an exhaust lever 6 and a brake lever 7, with both the exhaust lever 6 and also the brake lever 7 being divided. The exhaust lever 6 comprises a first exhaust lever part 6*a* on the camshaft side and a second exhaust lever part 6*b* on the exhaust valve side, and the brake lever 7 comprises a first brake lever part 7*a* on the camshaft side and a second brake lever part 7*b* on the exhaust valve side. All lever parts 6*a*, 6*b*; 7*a*, 7*b* are pivotably mounted about a common lever axis 21. Both the first and the second exhaust lever part 6*a*, 6*b* and also the first and second brake lever part 7*a*, 7*b* are pivotable about the lever axis 21 independent from one another. A respective spring 6*c* and 7*c* of low spring force (in comparison with the valve springs) is arranged between the two exhaust levers 6*a*, 6*b* and brake levers 7*a*, 7*b* for fixing the position.

A central lever 8 is also pivotably mounted about the lever axis 21 between the exhaust lever 6 and the brake lever 7. The middle lever 8 is the support body for a locking element 9, with which the two exhaust lever parts 6*a*, 6*b* or the two brake lever parts 7*a*, 7*b* can rotatably be connected with each other in a selective manner. The locking element 9 is formed in the embodiment by a piston 10 which can be displaced in a first position associated with normal driving operation between mutually facing pressure areas 6*a*' and 6*b*' of the first and second exhaust lever part 6*a*, 6*b* and in a second position associated with engine braking operation between mutually facing pressure areas 7*a*', 7*b*' of the first and second brake lever part 7*a*, 7*b*, so that the piston 10 acts as a force transfer element between the two lever parts 6*a*, 6*b* and 7*a*, 7*b*. The piston 10 is not subjected in this process to shearing but only to pressure, so that the wear and tear of the locking element 9 can be kept at a very low level.

The exhaust lever 6 acts via a valve bridge 11 on both exhaust valves 4*a*, 4*b*. The guidance of the valve bridge 11 in the cylinder head 1 is designated with reference 12. The brake lever 7 on the other hand acts via a tappet element 13 directly only on the valve shaft 4*a*' of the first exhaust valve 4*a*, as is illustrated in FIG. 3.

The exhaust lever 6 is actuated by an exhaust cam 14, and the brake lever 7 is actuated by a brake cam 15 of the camshaft 16.

The exhaust lever 6 is activated and the brake lever 7 is deactivated in normal driving operation. In braking operation on the other hand, the brake lever 7 is activated and the exhaust lever 6 is deactivated.

As is illustrated in FIG. 6 and FIG. 7, the stepped piston 10 forming the locking element 9 is displaceably guided in a stepped guide cylinder 17 of the middle lever 8 parallel to the lever axis 21. An annular face surface 23 of the piston 10 which is formed by a shoulder 22 borders a pressure chamber 18, into which a pressure channel 19 enters which is partly guided within the lever axis 21. The piston 10 is displaceable against the force of the restoring spring 20 between the two positions by pressurization of the pressure chamber 18, with respectively different ends 10*a*, 10*b* protruding laterally from the middle lever 8 in each of the two end positions and being positioned between the pressure areas 6*a*', 6*b*; 7*a*', 7*b*' of the exhaust lever parts 6*a*, 6*b* or the brake lever parts 7*a*, 7*b*.

The activation of the brake lever 7 and deactivation of the exhaust lever 6 occurs in that the locking element 9 is displaced under pressurization against the restoring force of the restoring spring 20 from the first position as illustrated in FIG. 6 to the second position as illustrated in FIG. 7. For the purpose of reactivating the exhaust lever 6 and deactivating the brake lever 7, the pressure chamber 18 is relieved from pressure and the piston 10 will be pushed back to the first position by the restoring spring 20.

Figure 8:
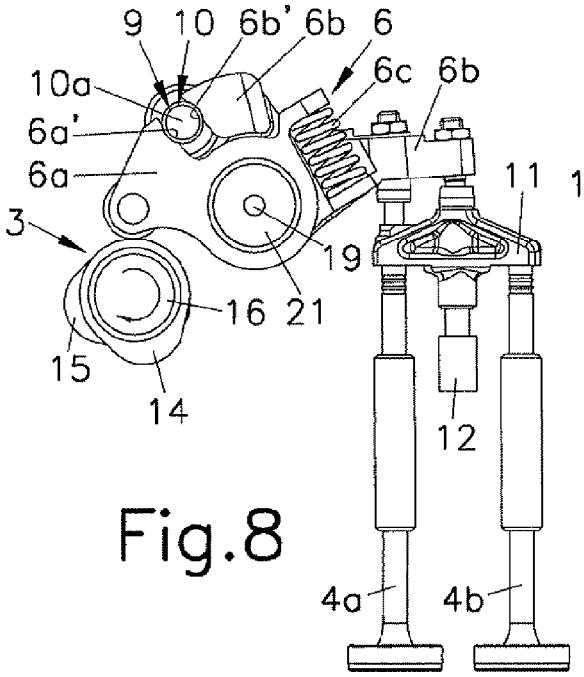
FIG. 8 illustrates the engine brake in driving operation with closed exhaust valves.
Figure 9:
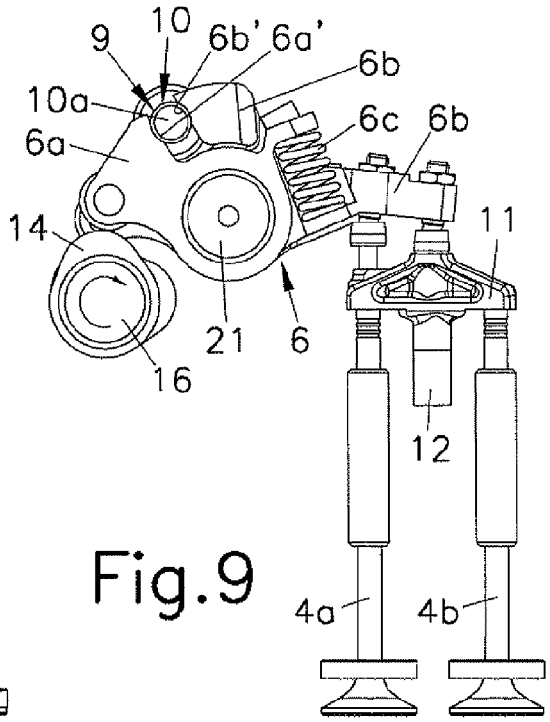
FIG. 9 illustrates the engine brake in driving operation with opened exhaust valves.

FIGS. 4, 8 and 9 show the valve actuation device 3 during normal driving operation, with both exhaust valves 4*a*, 4*b* being closed in FIG. 4 and FIG. 8. The brake lever 7 is deactivated, with the locking element 9 being situated in the first position. The exhaust lever parts 6*a* and 6*b* are rotationally connected with each other by the locking element 9. During the exhaust valve stroke, both exhaust valves 4*a*, 4*b* are opened conventionally by the exhaust lever 6 via the valve bridge 11.

Figure 10:
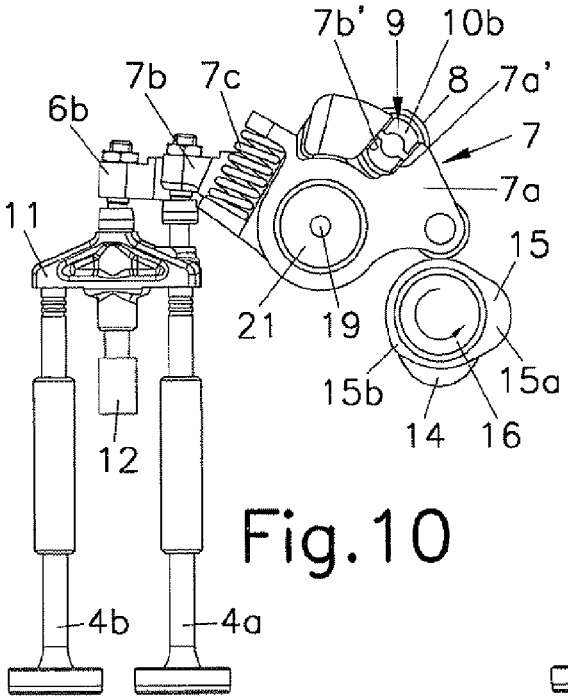
FIG. 10 illustrates the engine brake in braking operation with closed exhaust valves.
Figure 11:
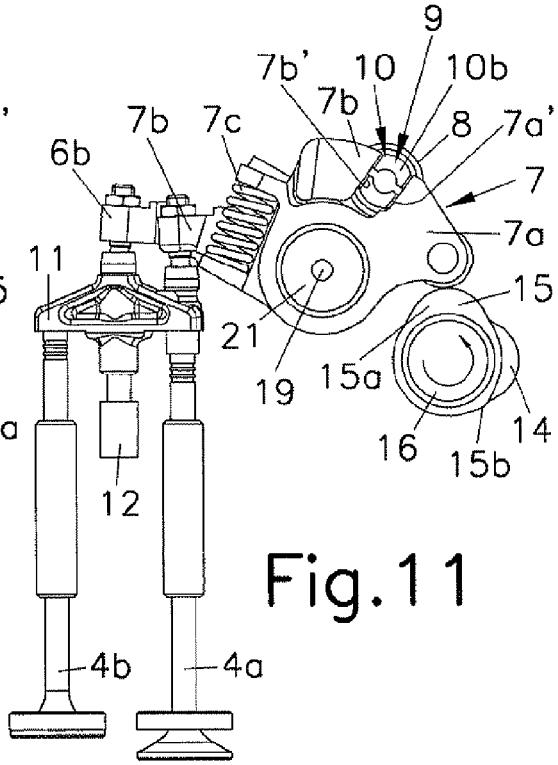
FIG. 11 illustrates the engine brake in braking operation with opened exhaust valve.

FIGS. 5, 10 and 11 show the valve actuation device 3 in engine braking operation, with the brake lever 7 being activated and the exhaust lever 6 being deactivated. The locking element 9 is situated in its second position. The exhaust lever parts 6*a* and 6*b* are separated from each other, the brake lever parts 7*a*, 7*b* on the other hand are rotationally connected with each other by the locking element 9. Both exhaust valves 4*a*, 4*b* are closed in FIG. 5 and FIG. 10. FIG. 11 illustrates the first braking phase during the expansion phase T1, which will be explained below in closer detail.

Figure 12:
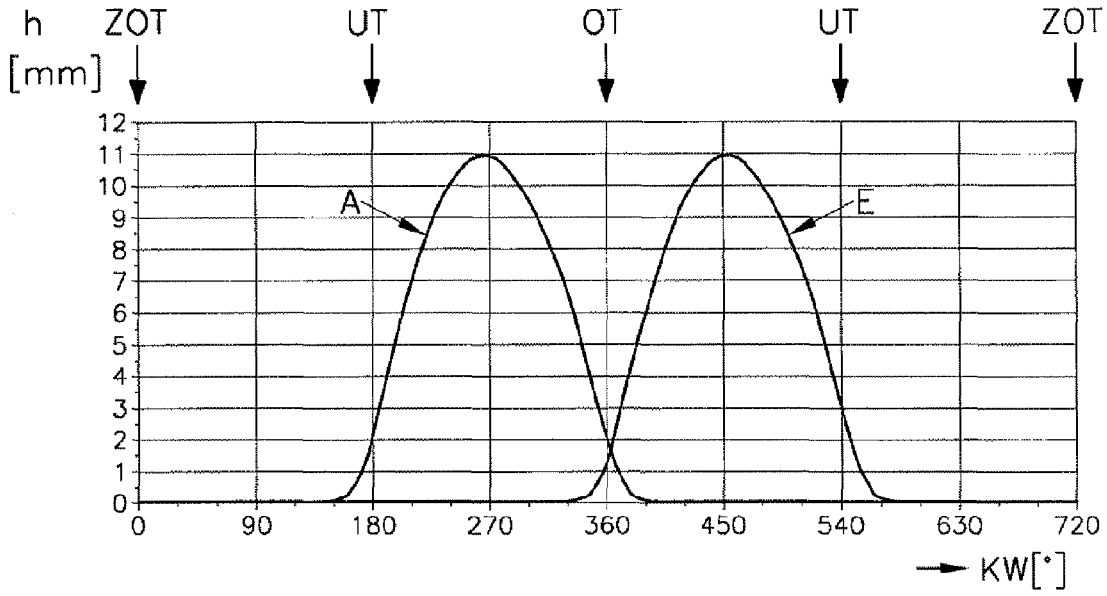
FIG. 12 illustrates a valve lift diagram of the internal combustion engine in normal driving operation.
Figure 13:
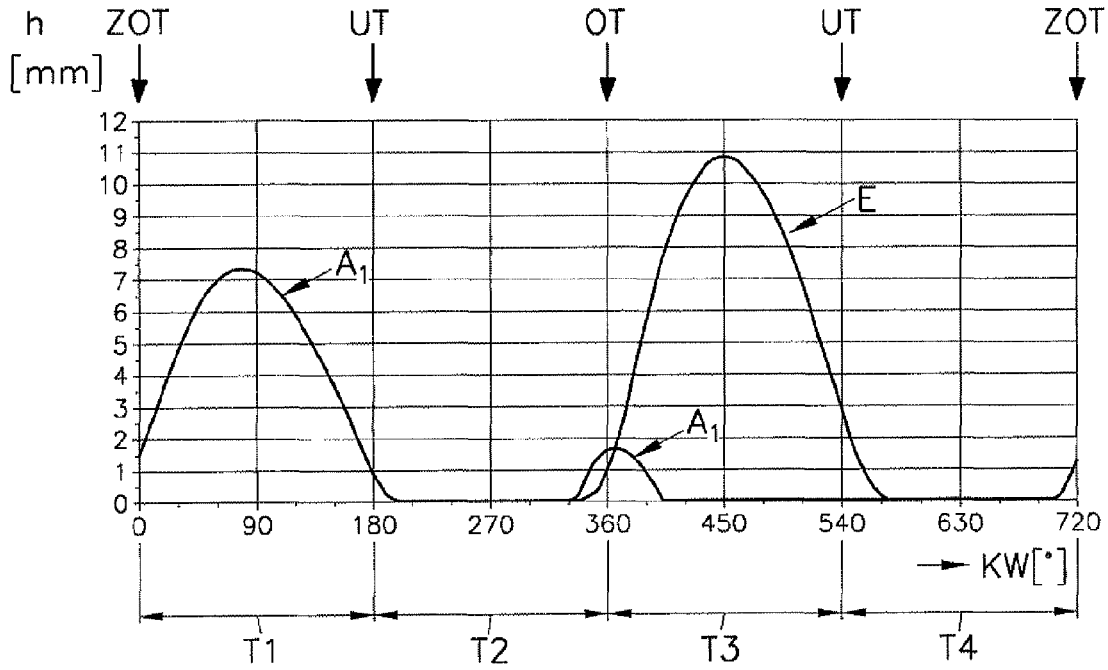
FIG. 13 illustrates a valve lift diagram of the internal combustion engine in braking operation.

FIGS. 12 and 13 respectively show the valve strokes h entered over the crank angle KW, with the stroke curves for the intake valves being designated with reference E. Furthermore, reference A1 designates the stroke curves of the first exhaust valve 4*a* and reference A designates the stroke curve of the valve bridge 7 and therefore also of the two exhaust valves 4*a*, 4*b*.

FIG. 12 illustrates the valve strokes h for normal driving operation, with UT designating the bottom dead centers, OT designating the upper dead centers of the charge change, and ZOT designating the upper dead centers of the ignition.

FIG. 13 illustrates the stroke curves h for the intake and exhaust valves E, A for the braking operation. The expansion phase is designated with T1, the exhaust phase with T2, the intake phase with T3, and the compression phase with T4. The brake lever 7 is activated by the second position of the locking element 9 and the exhaust lever 6 is simultaneously deactivated. The illustration clearly illustrates that opening of the first exhaust valve 4*a* occurs during the expansion phase T1.

Since the brake cam 15 comprises an additional cam 15*b* in addition to the main elevation 15*a*, double opening of the first exhaust valve 4*a* occurs, with the second opening being carried out in the region of the upper dead center OT of the charge change. This second opening of the exhaust valve 4*a* allows load-free opening of the intake valves.

A high valve stroke of the exhaust valve 4*a* with large opening cross-section occurs in the expansion phase T1, by means of which a good degree of filling and therefore a high compression pressure can be achieved at the beginning of the exhaust phase. Since the braking effect occurs both in the exhaust and in the compression phase T2, T4, high braking power is enabled.

What is claimed is:

1. An internal combustion engine, comprising:

an engine brake;

at least one exhaust valve per cylinder;

a camshaft;

at least one valve lever arrangement configured to actuate the at least one exhaust valve via the camshaft, the valve lever arrangement having an exhaust lever and a brake lever, the exhaust lever having a first exhaust lever part on a camshaft side and a second exhaust lever part on an exhaust valve side, the first exhaust lever part and the second exhaust lever part each configured for rotatable mounting about a lever axis independent of each other and also for rotational connection to each other by a locking element outside of an engine braking operation, the brake lever having a first brake lever part on the camshaft side and a second brake lever part on the exhaust valve side, the first brake lever part and the second brake lever part each configured for rotatable mounting about the lever axis independent of each other and also for rotational connection to each other in the engine braking operation by the locking element;

an exhaust cam configured to actuate the exhaust lever; and a brake cam configured to actuate the brake lever, wherein the locking element is configured to be mounted on a middle lever which is configured to be rotatably mounted about the lever axis between the exhaust lever and the brake lever.

2. The internal combustion engine of claim 1, wherein the locking element is configured for adjustment between a first position and a second position.

3. The internal combustion engine of claim 2, wherein the first position is associated with a driving operation and the second position is associated with the engine braking operation.

4. The internal combustion engine of claim 3, wherein:

the exhaust lever is configured for activation in the first position; and the brake lever is configured for deactivation in the first position.

5. The internal combustion engine of claim 3, wherein:

the exhaust lever is configured for deactivation in the second position; and the brake lever is configured for activation in the second position.

6. The internal combustion engine of claim 1, wherein the brake cam is configured to be spatially arranged with respect to the exhaust cam in a phase-shifted manner advanced by approximately 90°.

7. The internal combustion engine of claim 1, wherein the brake lever is configured to act directly on a valve shaft of a first exhaust valve of the at least one exhaust valve.

8. The internal combustion engine of claim 1, wherein the exhaust lever is configured to act indirectly via a valve bridge on at least one first and one second exhaust valve per cylinder.

9. The internal combustion engine of claim 1, wherein the locking element comprises a stepped piston configured to be displaceably mounted in a stepped guide cylinder parallel to the lever axis.

10. The internal combustion engine of claim 1, wherein the middle lever is configured to be rotationally connected via the locking element with the activated the brake lever and the activated exhaust lever.

11. The internal combustion engine of claim 1, wherein the locking element is configured for movement between pressure areas of the first exhaust lever part and the second exhaust lever part, or the first brake lever part and the second brake lever part.

12. The internal combustion engine of claim 1, further comprising an annular face surface formed by a shoulder of a piston, the annular face surface configured to border a pressure chamber within a middle lever.

13. The internal combustion engine of claim 1, wherein the pressure chamber is configured for connection to a pressure line.

14. The internal combustion engine of claim 1, wherein the locking element is configured for hydraulic displacement against a force of a restoring spring.

15. The internal combustion engine of claim 1, wherein the locking element is configured for pneumatic displacement against a force of a restoring spring.

16. An internal combustion engine comprising:

an engine brake;

an exhaust valve per cylinder;

a camshaft;

a valve lever arrangement configured to actuate the exhaust valve via the camshaft, the valve lever arrangement having:

an exhaust lever with a first exhaust lever part on a camshaft side and a second exhaust lever part on an exhaust valve side, the first exhaust lever part and the second exhaust lever part each configured for rotatable mounting about a lever axis independent of each other; and a brake lever with a first brake lever part on the camshaft side and a second brake lever part on the exhaust valve side, the first brake lever part and the second brake lever part each configured for rotatable mounting about the lever axis independent of each other;

a locking element configured to rotatably connect:

the first exhaust lever part and the second exhaust lever part to each other outside of an engine braking operation; and the first brake lever part and the second brake lever part to each other in the engine braking operation;

an exhaust cam configured to actuate the exhaust lever; and a brake cam configured to actuate the brake lever, wherein the locking element is configured to be mounted on a middle lever which is configured to be rotatably mounted about the lever axis between the exhaust lever and the brake lever.

17. The internal combustion engine of claim 16, wherein the locking element is configured for adjustment between a first position associated with a driving operation and a second position associated with the engine braking operation.

18. The internal combustion engine of claim 17, wherein:

the exhaust lever is configured for activation in the first position; and the brake lever is configured for deactivation in the first position.

19. The internal combustion engine of claim 17, wherein:

the exhaust lever is configured for deactivation in the second position; and the brake lever is configured for activation in the second position.

20. An internal combustion engine, comprising:

an engine brake;

at least one exhaust valve per cylinder;

a camshaft;

at least one valve lever arrangement configured to actuate the at least one exhaust valve via the camshaft, the at least one valve lever arrangement having an exhaust lever and a brake lever, the exhaust lever having a first exhaust lever part on a camshaft side and a second exhaust lever part on an exhaust valve side, the first exhaust lever part and the second exhaust lever part each configured for rotatable mounting about a lever axis independent of each other and also for rotational connection to each other by a locking element outside of an engine braking operation, the brake lever having a first brake lever part on the camshaft side and a second brake lever part on the exhaust valve side, the first brake lever part and the second brake lever part each configured for rotatable mounting about the lever axis independent of each other and also for rotational connection to each other in the engine braking operation by the locking element;

an exhaust cam configured to actuate the exhaust lever; and a brake cam configured to actuate the brake lever, wherein the locking element comprises a stepped piston configured to be displaceably mounted in a stepped guide cylinder parallel to the lever axis.

21. The internal combustion engine of claim 20, wherein the locking element is configured to be mounted on a middle lever which is configured to be rotatably mounted about the lever axis between the exhaust lever and the brake lever.

* * * * *